United States Patent [19]

Hinchcliffe et al.

[11] Patent Number: 4,667,687

[45] Date of Patent: May 26, 1987

[54] UNITING ROD-LIKE ARTICLES, PARTICULARLY FOR FILTER CIGARETTE MANUFACTURE

[75] Inventors: Dennis Hinchcliffe, London, England; Francis A. M. Labbe, Neuilly-sur-Seine, France; Desmond W. Molins; Edward J. Orpin, both of London, England

[73] Assignee: Molins PLC, Milton Keynes, England

[21] Appl. No.: 686,797

[22] Filed: Dec. 26, 1984

[30] Foreign Application Priority Data

Dec. 30, 1983 [GB] United Kingdom ..... 8334664

[51] Int. Cl.[4] ..... A24C 5/47; A24C 5/52

[52] U.S. Cl. ..... 131/94; 131/61.1; 131/69; 131/95

[58] Field of Search ..... 131/94, 61.1, 69, 95, 131/280, 60, 167; 198/438, 431

[56] References Cited

U.S. PATENT DOCUMENTS

| | | | |
|---|---|---|---|
| 2,649,761 | 8/1953 | Edwards | 131/94 |
| 3,638,661 | 2/1972 | Pinkham . | |
| 4,040,430 | 8/1977 | Molins | 131/94 |
| 4,046,063 | 9/1977 | Burger . | |
| 4,249,547 | 2/1981 | Hinzmann | 131/94 |
| 4,262,680 | 4/1981 | Hinzmann | 131/94 |
| 4,277,301 | 7/1981 | McIntyre et al. | 131/69 |
| 4,361,156 | 11/1982 | Hall | 131/90 |
| 4,527,570 | 7/1985 | Porenski et al. . | |
| 4,548,216 | 10/1985 | Ahern | 131/94 |

FOREIGN PATENT DOCUMENTS

| | | |
|---|---|---|
| 766752 | 1/1957 | United Kingdom . |
| 864247 | 3/1961 | United Kingdom . |
| 929270 | 6/1963 | United Kingdom . |
| 959345 | 5/1964 | United Kingdom . |
| 1129612 | 10/1968 | United Kingdom . |
| 1211992 | 11/1970 | United Kingdom . |

*Primary Examiner*—V. Millin
*Assistant Examiner*—H. Macey
*Attorney, Agent, or Firm*—John C. Smith, Jr.

[57] ABSTRACT

Filter cigarettes are produced by uniting tobacco sections (12, 122) and filter portions (21, 120) with a wrapper (28, 124) which carries a relatively thick circumferential bead (126) of adhesive or other filler material to provide an effective seal around the cigarette. The cigarettes may be assembled on parallel assembly lines (16, 18) supplied with tobacco sections from a common maker line (10) by a carrier conveyor (14) arranged to supply alternate sections to different assembly lines disposed at 90° to the maker line.

28 Claims, 15 Drawing Figures

UNITING ROD-LIKE ARTICLES, PARTICULARLY FOR FILTER CIGARETTE MANUFACTURE

This invention relates to uniting rod-like articles, particularly for manufacture of filter cigarettes.

According to one aspect of the invention a method of uniting rod-like articles of the tobacco industry, particularly in the manufacture of filter cigarettes, includes the steps of assembling at least two articles in axially adjacent positions, pressing a wrapper onto at least the adjacent end portions of said articles, and uniting said articles by adhesively securing the wrapper around each of said articles, wherein filler material to form a relatively thick annular region is interposed between the wrapper and at least one of said articles substantially to seal the space between the wrapper and said article after uniting.

According to another aspect the invention provides a method of uniting rod-like articles of the tobacco industry, particularly in the manufacture of filter cigarettes, including the steps of assembling at least two articles in axially adjacent positions, pressing a wrapper onto at least the adjacent end portions of said articles, and uniting said articles by adhesively securing the wrapper around each of said articles, wherein the wrapper is adhesively secured to at least one of said articles by a sealing region of filler material which is of such thickness that the wrapper is spaced from the article for a substantial proportion of its circumference.

A substantially annular space may surround said article beneath said wrapper at least in a region adjacent said filler material. In this case, particularly, the wrapper is preferably spaced from the article by said filler material by a distance of at least of the order of 0.1 mm. The filler material may form a band around said article having a width in the direction of the length of said wrapper along said article which is substantially less than said length. The filler material is preferably located at or near an edge of the wrapper.

The filler material may comprise a bead of adhesive. Alternatively, the filler material may include a strip of material (e.g. paper or card) adhesively secured to the wrapper and to the article. Preferably the filler material is applied to the wrapper upstream of the position at which the wrapper is applied to the articles and is subsequently carried by the wrapper.

Separate annular regions of filler material may be provided surrounding each of said articles. An article may include more than one region of filler material. An annular space may surround at least one of said articles between separate regions of filler material. The wrapper may be provided with ventilation holes at a location between spaced regions of filler material.

Preferably the wrapper carries at least one line of adhesive extending in an axial direction for locating the wrapper relative to said articles. In a further preferred arrangement the articles and the wrapper are moved in an axial direction while the wrapper is wrapped around the articles. A substantially continuous stream of articles may be wrapped in a substantially continuous wrapper, or groups of articles may be wrapped in separate wrappers which span preselected adjacent articles.

The wrapper may be resiliently pressed onto and around the articles while being conveyed with the articles. Preferably the pressure applied to the wrapper to wrap it around the articles is greater than that (if any) applied to other parts of the articles.

According to another aspect of the invention apparatus for performing the method of the invention includes means for conveying rod-like articles in axially adjacent positions, means for delivering a wrapper to at least the adjacent end portions of articles to be united, and means for wrapping and feeding the wrapper around at least the end portions of the articles to unite the articles, characterised by means for applying filler material to form a relatively thick band to seal the space between the wrapper and at least one of said articles.

The applying means may comprise means for applying said filler material to the wrapper at a position upstream of said delivering means. Means may be provided for conveying a substantially continuous wrapper, said applying means being arranged to apply filler material to said continuous wrapper at regularly spaced intervals. In this case means for severing said continuous wrapper at positions between said regions of filler material may also be provided, said severing means being located between said applying means and said delivering means.

The conveying means may be arranged to convey a substantially continuous stream of articles in an axial direction. The wrapping means may include means for resiliently pressing the wrapper onto and around the articles. The conveying means may be arranged to convey substantially parallel streams of articles and said delivery means may be arranged to apply separate wrappers to articles in each of said streams. The conveying means may include means for converting a first stream of articles into second and third substantially parallel streams of articles. The conveying means may further include means for conveying first articles and means for conveying second articles, and means for combining said first and second articles in a common stream, each of said means for conveying first articles and said means for conveying second articles including means for conveying substantially parallel streams of articles.

Providing a relatively thick bead of adhesive or other filler material may compensate for spaces which may occur between the wrapper and the article or articles, especially where the uniting method does not involve rolling of the wrapper and articles to be united. Hence irregularities of size and shape of articles and differences in size and shape of articles to be united may be accommodated better than prior arrangements.

Sealing of the wrapper to the articles is particularly important for filter cigarettes provided with dilution holes (i.e. controlled ventilation through the wrapper). The adhesive bead or other filler material may also be regarded as a spacer between the wrapper and the articles and may be beneficial in allowing more controlled ditution of filter cigarettes.

The filter material need not be applied in the same form as it eventually assumes. For example a series of spaced dots of adhesive applied to the wrapper may form a continuous band around the article after application of pressure to apply the wrapper.

The invention will be further described, by way of example only, with reference to the accompanying diagrammatic drawings in which.

Figures 5, 6, 7:
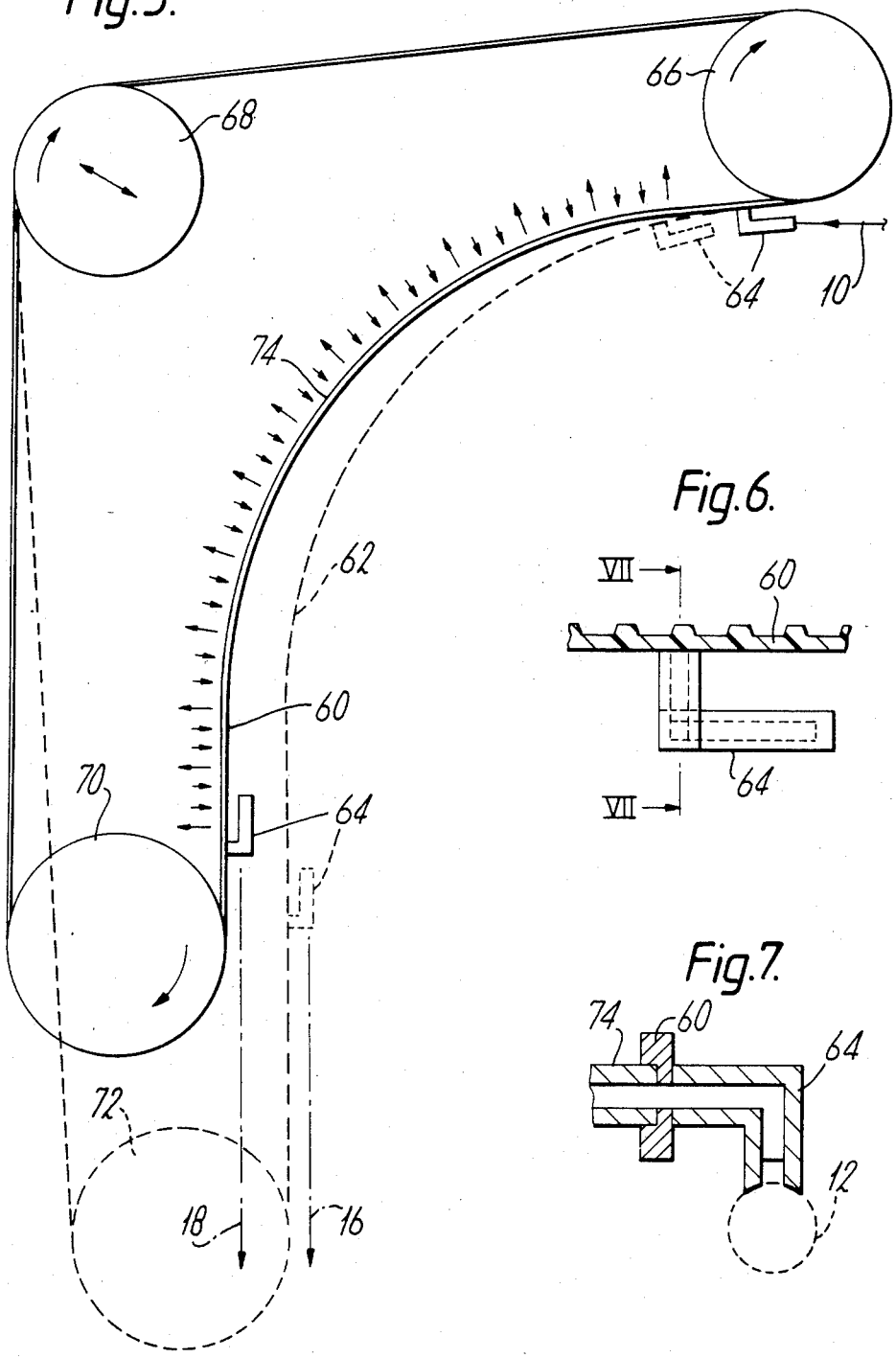
FIG. 5 is a plan view of part of a modified machine.
Figure 8:
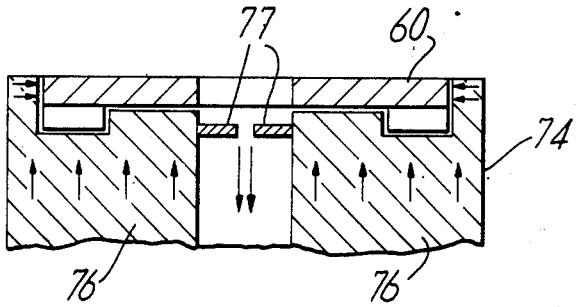
Figure 9:
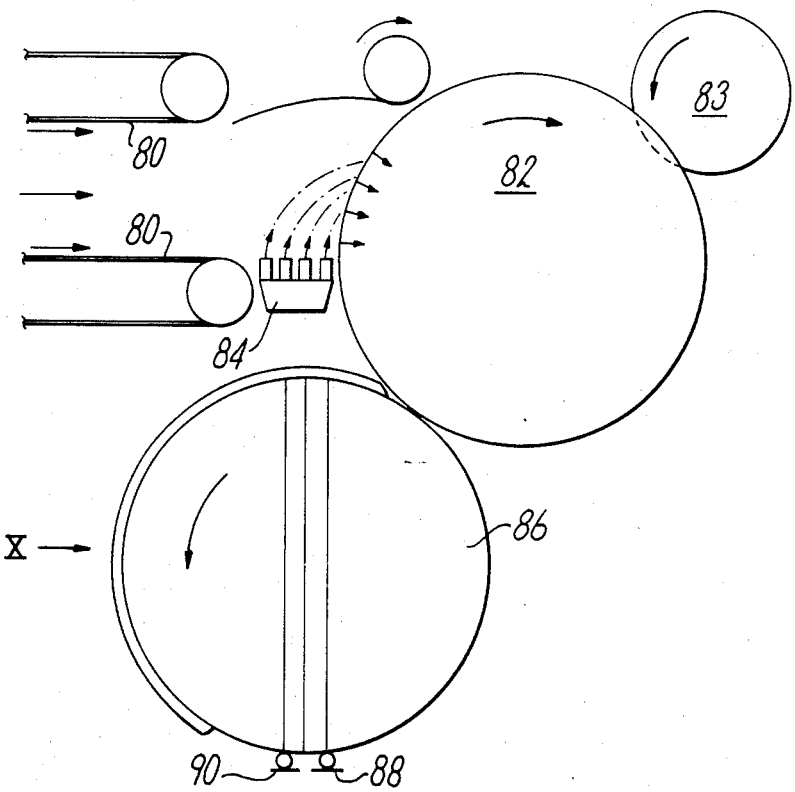
Figure 10:
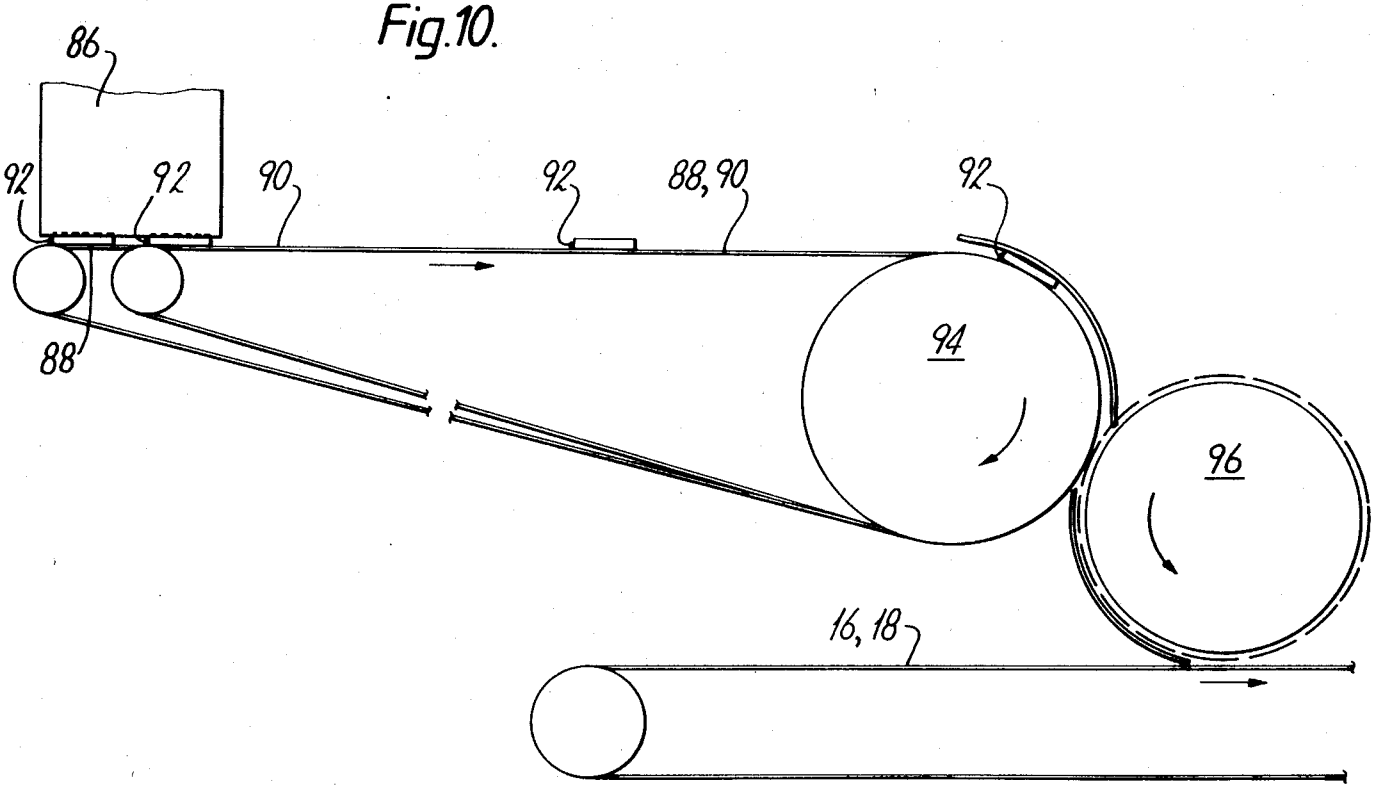
Figure 11:
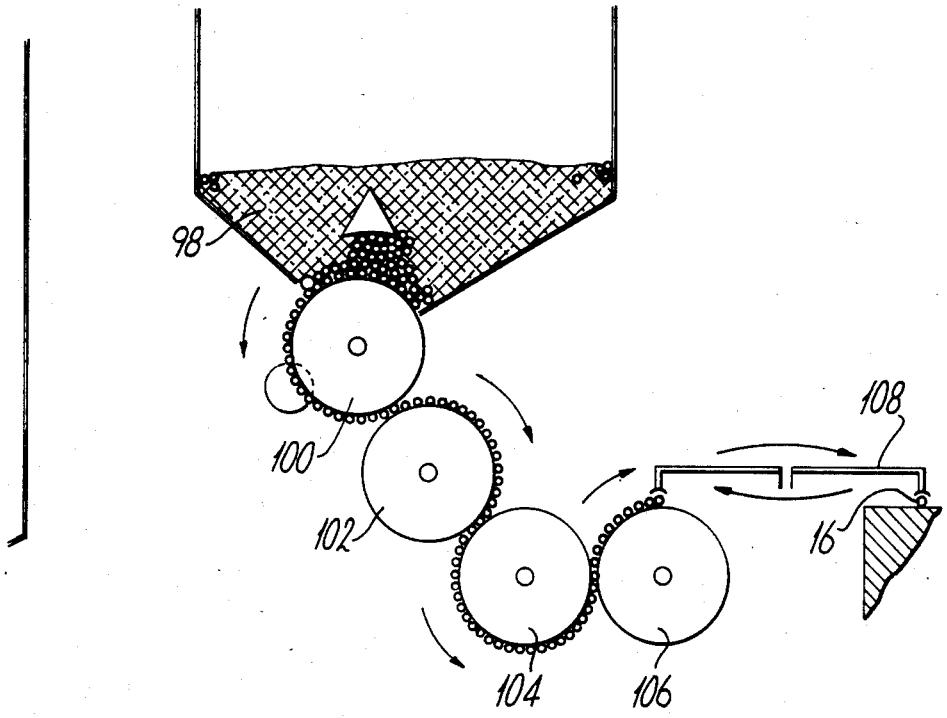
Figure 12:
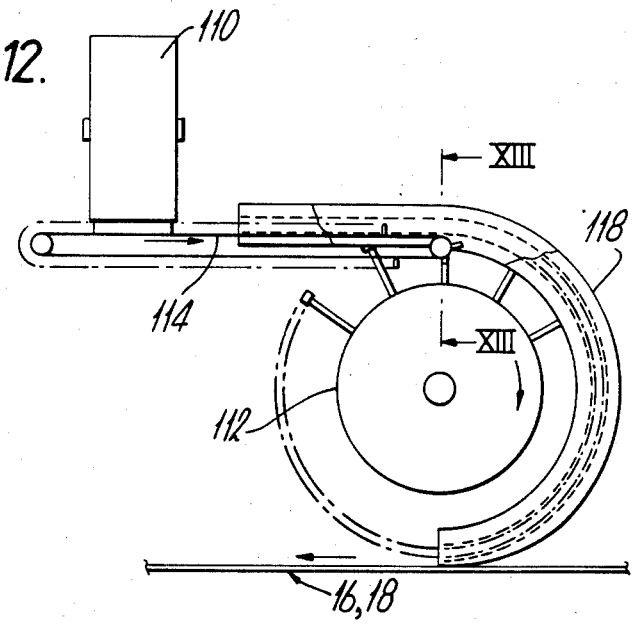
Figure 13:
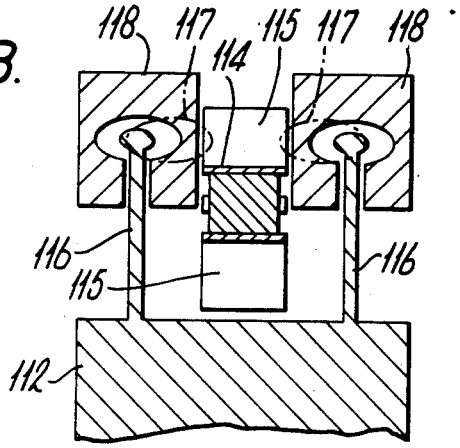
Figure 14:
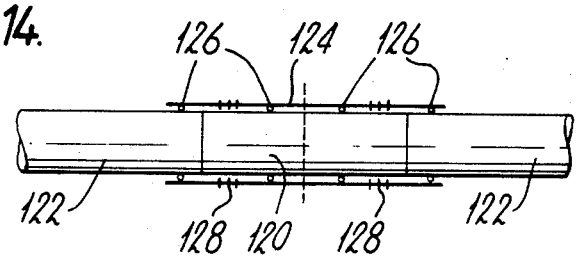
Figure 15:
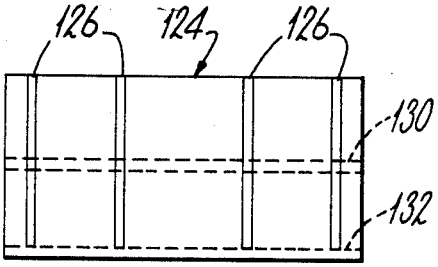

FIG. 6 is an enlarged longitudinal sectional view of a conveyor of the machine of FIG. 5, FIG. 7 is a sectional view of the line VII—VII of FIG. 6, FIG. 8 is a sectional view of another conveyor for use with the machine of FIG. 5, FIG. 9 is a side view of an arrangement for feeding filters to the machine of FIG. 5, FIG. 10 is a view of the arrangement of FIG. 9 in the direction of arrow X, FIG. 11 shows another filter conveying arrangement, FIG. 12 is a side view of a further filter conveying arrangement, FIG. 13 is a sectional view on the line XIII—XIII of FIG. 12, FIG. 14 is a sectional view of a filter cigarette assembly, and FIG. 15 is a plan view of the wrapper of the assembly of FIG. 14.

Figure 1:
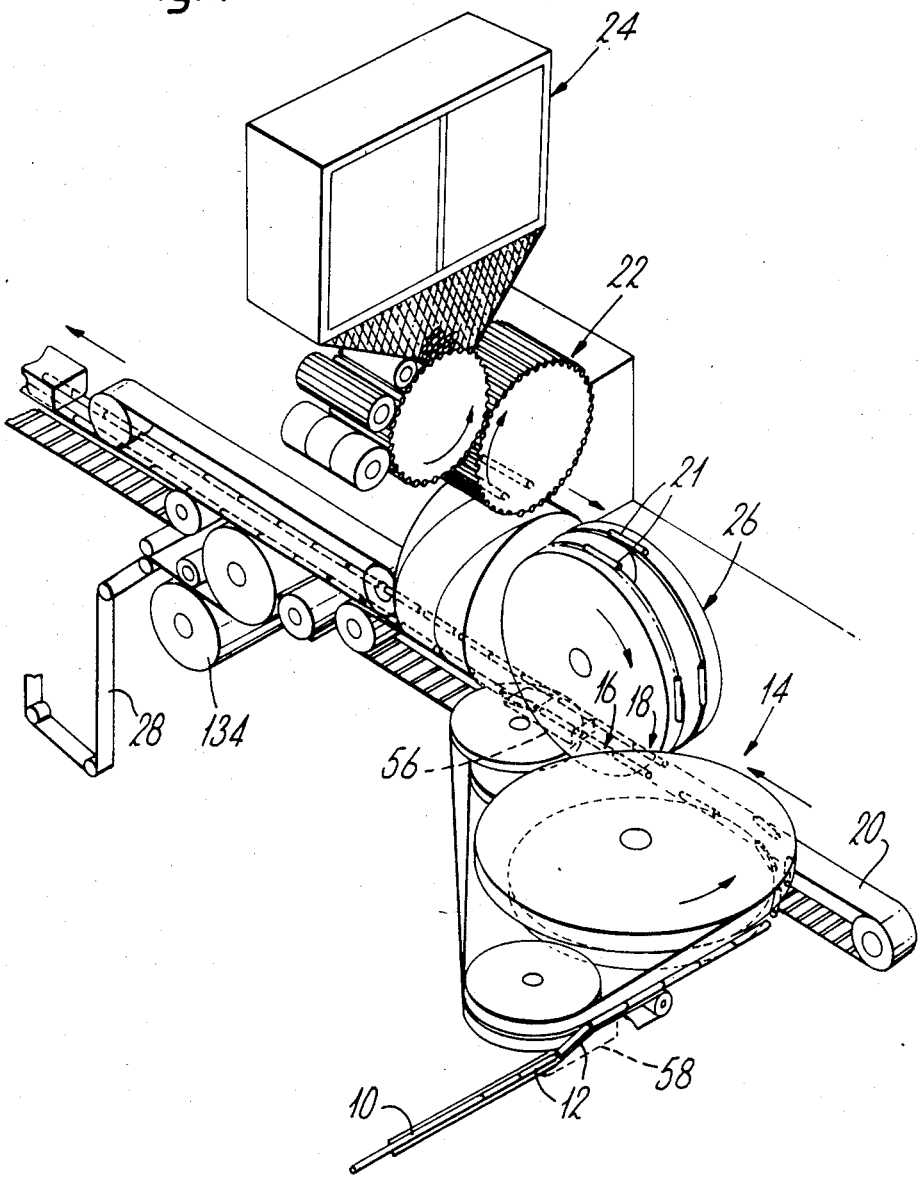
FIG. 1 is a perspective view of part of a filter cigarette making machine.

FIG. 1 shows a rod line 10 along which wrapped tobacco sections 12 are delivered, e.g. from a Molins Mk. 9 cigarette making machine, to a conveyor arrangement 14 which receives each section 12 and delivers it to one of a pair of rod lines 16, 18 and are received on a suction conveyor 20. Predetermined gaps between the sections 12 on the lines 16, 18 receive filter portions 21 delivered from a filter conveying arrangement 22, which delivers filters in parallel streams for each rod line from a hopper 24 to an insertion drum 26. Downstream of the drum 26 the tobacco sections and filter portions on each line 16, 18 are assembled into groups and wrappers cut from a wrapper web 28 are applied to each group to form filter cigarette assemblies. The arrangement for grouping and forming such assemblies may be substantially as disclosed in British patent specification No. 2126467 and U.S. patent application Ser. No. 528,923, filed Sept. 2, 1983 by Francis A.M. Labbe, the disclosures of which are hereby incorporated herein in their entirety.

Figure 2:
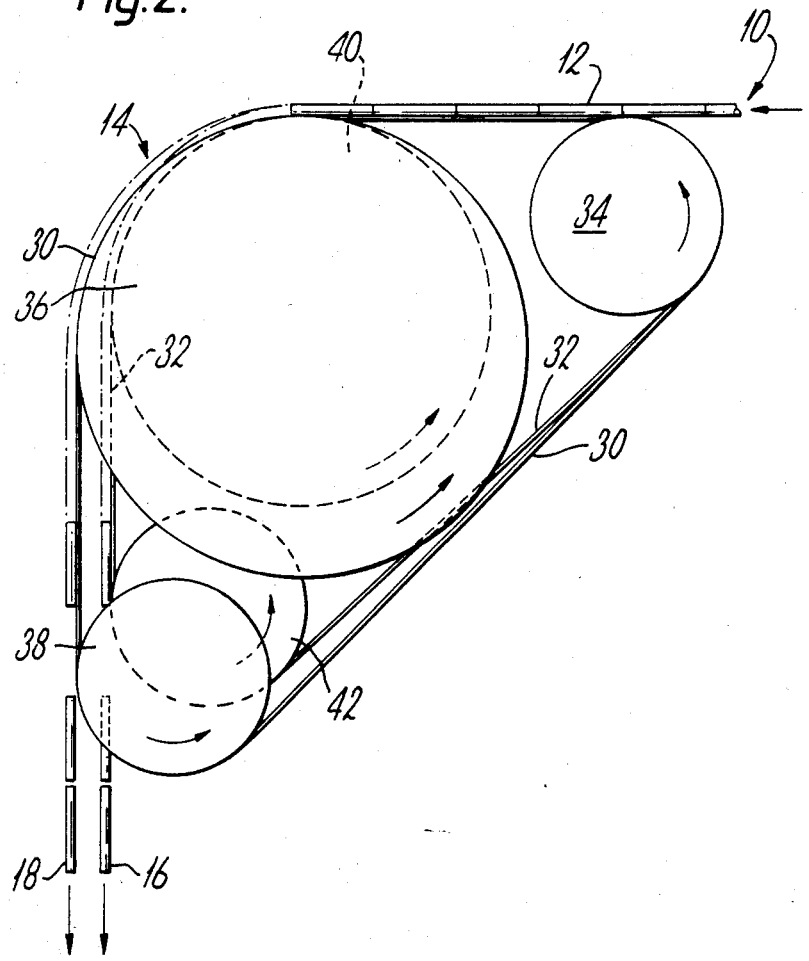
FIG. 2 is a plan view of part of the machine of FIG. 1.
Figure 3:
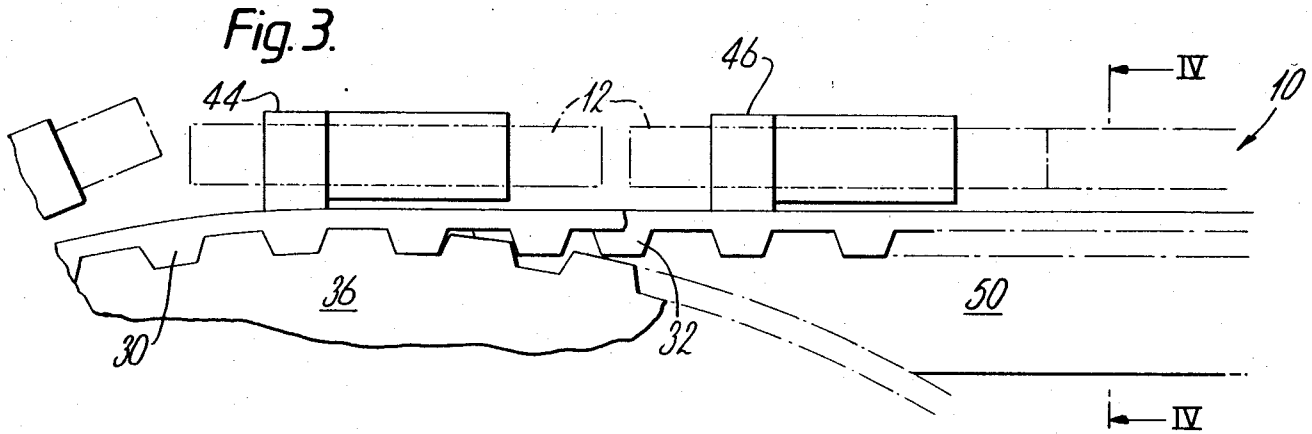
FIG. 3 is an enlarged view of part of the machine of FIG. 1.
Figure 4:
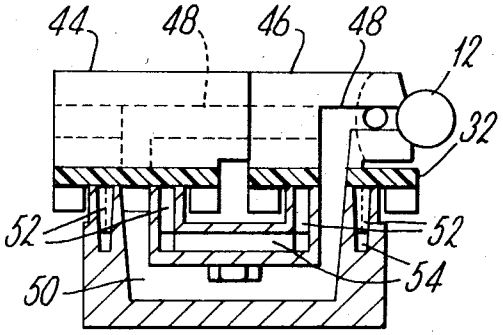
FIG. 4 is a sectional view on the line IV—IV of FIG. 3.

The conveyor arrangement 14 for receiving tobacco sections 12 and for delivering alternate sections to the rod lines 16, 18 is shown in FIG. 2 and comprises an upper band conveyor 30 and a lower band conveyor 32, each of which have carriers as shown in FIGS. 3 and 4 for receiving tobacco sections 12. The upper conveyor 30 passes around pulleys 34, 36, 38 and the lower conveyor 32 passes around pulleys 34, 40, 42. As shown in FIGS. 3 and 4 the conveyors 30, 32 respectively include series of carriers 44, 46, the spacing and phasing of which are such that carriers in each series receive alternate tobacco sections 12 from the rod line 10. In order to acheive this the carriers 44, 46 are provided with suction channels 48 which cooperate with a suction chamber 50 arranged adjacent each of the rod lines 10, 16, 18 and also with suction chambers associated with the pulleys 34, 36 and 40. The suction chamber 50 associated with the rod line 10 is common for both the conveyors 30 and 32. Separate suction chambers are provided for the conveyors 30 and 32 in the vicinity of the lines 16 and 18 to allow separate release of the tobacco sections onto the respective line. The carriers 44 and 46 are substantially similar except that the carrier 44 of the upper conveyor 30 has a longer downwardly extending portion as that it extends to the same position (i.e. the rod line 10) as the carrier 46 of the lower conveyor 32. In order to reduce frictional contact between the conveyors 30, 32 and stationary guides an air bearing provided by porous material 52 (such as VYON or PORVAIR) cooperates with a pressure manifold 54.

In operation successive tobacco sections 12 are picked up by suction so that alternate sections are conveyed by the conveyors 30 and 32. Release of the respective sections onto the rod lines 16, 18 (along the length of the conveyor between the pulleys 36 and 38 or 40 and 42), by release of suction holding the sections 12 on the carriers 44 and 46, may be arranged to provide the required spatial relationship between the tobacco sections on the lines 16 and 18 so as to allow timing of the sections on each line by a single timing device, as explained in said British patent specification No. 2126467. Alternatively, also as explained in said specification, adjustment of position of individual articles on the conveyor 20 may be made by means of side suction bands.

In order to allow controlled release of the tobacco sections 12 onto the rod lines 16 and 18 and still allow clearance so that the carriers on the conveyor 30 can cross the rod line 16 the conveyor 20 (or individual conveyors associated with the rod lines 16 and 18) should be somewhat lower than the path of the carriers at the crossing position but somewhat higher (although still below said path), so that the conveyor and carriers are close enough to allow controlled transfer, at the point of release. Thus the rod lines 16, 18 may include a downwardly inclined portion or ramp 56 between the release and crossing positions. Similarly at the point of pick-up on the rod line 10 the tobacco sections 12 may pass up a ramp 58 after the carriers 44, 46 have crossed the line 10 so as to bring the sections into close proximity with the carriers for successful transfer. The carriers 44, 46 may therefore convey the tobacco sections 12 at a level which is slightly raised relative to the general level of the rod lines 10, 16, 18 and the ramp 58 may be provided to raise tobacco sections to this level and the ramp 56 provided to lower tobacco sections from the level.

The conveying arrangement 14 has the possible disadvantage that access to the path of the tobacco sections 12 is obstructed by runs of the conveyors 30 and 32. An alternative arrangement not having this disadvantage is shown in FIG. 5. Upper and lower suction conveyors 60 and 62 having carriers 64 similar to the carriers 44 and 46 pass around pulleys 55, 58, 70 and 72, which are arranged on the outside of the curve leading from the rod line 10 to the lines 16 and 18. The position of at least one of the pulleys 70, 72 is adjustable, so that the relative positions of tobacco sections 12 deposited on the lines 16 and 18 may be adjused. The concave run of the conveyor 60 is guided by a concave track 74. A similar track (not shown) is provided for the conveyor 62. The conveyor 60 and a carrier 64, together with part of the track 74, are shown in FIGS. 6 and 7.

It will be apparent that certain conditions must be satisfied to ensure that the tobacco sections 12 are retained on the carriers 64 and also that the conveyors 60 and 62 remain in contact with their respective tracks 74. One such condition is that the suction force acting on the conveyor 60 (or 62) must exceed that force due to tension in the conveyor which tends to straighten the conveyor (i.e. to draw it away from the track 74). When the conveyor is moving the suction force is aided by centrifugal force acting on the conveyor (but such force is not present when the conveyor is stationary and the conveyor must remain in contact with the track 74 even when it is stationary). Thus the suctional force must always be greater than the maximum tensional force. This condition cannot safely be satisfied unless measures are taken to reduce friction which would otherwise effectively increase tension in the moving conveyor. Accordingly friction may be substantially avoided by providing an air bearing for the conveyor 60 on the track 74. In order to keep the conveyor just clear of the track the air bearing pressure must exceed the sum of the suctional force and the maximum centrifugal force. Thus the conditions to be satisified are that the air bearing pressure minus the maximum centrifugal force must be greater than the suctional force which in turn must be greater than the maximum tensional force in the conveyor. Therefore, the maximum tension must not exceed a value which both suction and pressure can safely cope with. FIG. 8 shows an arrangement intended to facilitate achievement of this.

In FIG. 8 the track is constructed of porous material 76 (such as VYON or PORVAIR) which has a microporous structure allowing substantial passage of air and through which air under pressure is supplied to provide an air bearing for the conveyor 60. It may be possible to replace the side parts of the track 74 with non-porous low-friction material.

It is also important that the suctional effect on the conveyors 60 and 62 is not substantially reduced by missing tobacco sections. This may be achieved by selecting a suitable suction pump or fan which is not particularly sensitive to flow changes. Alternatively, or additionally, flow rstrictors 77 may be provided to prevent loss of suction where no tobacco section is present. Similar flow restrictors may also be associated with the receiving conveyor 20 so as to reduce loss of suction where no tobacco section is present. Full suction may be applied (i.e. with no restrictor) in the region where the sections 12 are received so as to ensure a positive pick-up of the sections 12. Reference is directed to British patent specification No. 2126466 and U.S. patent application Ser. No. 508,399 filed June 27, 1983 by Francis A. M. Labbe, now U.S. Pat. No. 4,643,203, the disclosures of which are hereby incorporated herein in their entirety, particularly for further details of suitable flow restrictor arrangements.

Filters may be supplied to the rod lines 16, 18 in accordance with the disclosures of said British patent specifications Nos. 2126466 and 2126467. An alternative arrangement, intended particularly for oval filters is shown in FIGS. 9 and 10. A mass flow stream of filters is delivered by conveyors 80 to a fluted drum 82. In order to aid loading of the filters into the flutes the filters adjacent the drum may be fluidized by passing air upwards through the stream from a porous bridge 84. Filters are severed on the drum 82 by one or more knives 83 and passed to a further drum 86 on which the severed filters are axially separated. Parallel extractor belts 88, 90 having lugs 92 for engaging filters are provided for stripping the filters from the two lowermost flutes of the drum 86. Subsequently the extracted filters are delivered by means of an end pulley 94 and filter insertion disc 96 into the respective rod line 16 or 18.

An alternative filter supply arrangement, in which filters contained in a hopper 98 are delivered by a series of drums 100, 102, 104, 106 to a position at which a horizontally-disposed disc 108 transfers them directly onto one of the rod lines 16, 18, is shown in FIG. 11. A similar arrangement would be provided for the other of the rod lines 16, 18.

FIGS. 12 and 13 show a further arrangement for feeding filters (which in this case are oval in cross-section) from a drum 110 to an insertion disc 112. An extraction belt (or belts) 114 having lugs 115 for feeding filters from the lowermost flutes of the drum 110 is arranged to convey the filters on diverging paths into the range of the insertion disc 112, which carries radially extending fingers 116 adapted to pass through guides 118 which surround the disc 112 and deliver the filters onto the rod lines 16 and 18. The positions of filters upstream of the guides 118 on the belt 114 is indicated at 117 in FIG. 13.

In order that a satisfactory seal may be formed by the wrapper which joins the filter portion to the tobacco section in a machine such as that of FIG. 1, resilient pads may be used, as disclosed in said British patent specification No. 2126466, to press the wrapper onto the tobacco sections and filter portion. Reference is directed to that specification for details of the use of the pads. Additionally, the wrappers are provided with thick collars or beads of adhesive to aid sealing of any gap between the filter section and tobacco section and the wrapper.

FIG. 14 shows a cigarette assembly comprising a filter portion 120 and tobacco sections 122. The portion 120 and sections 122 are joined by a wrapper 124 carrying filler material in the form of relatively thick sealing beads 126 of adhesive. Ventilation holes 128 are provided in the wrapper 124 between the beads 126. The form of the wrapper 124 before application to the assembly is shown in FIG. 15. Films 130, 132 of adhesive of normal thickness are provided respectively for centre-line gumming to initially locate the wrapper 124 and for lap sealing, the beads 126 being normally squashed to normal thickness at the positions of the films 130, 132 by initial placement of the assembly on the wrapper and by the action of lap sealing.

Typically the wrapper 124 could be spaced from the portion 120 and section 122 by about 0.1 mm compared with a typical conventional spacing of 0.01 mm.

The larger gap between the wrapper and the tobacco sections and filter portion allows better control of ventilation provided that the seal of the adhesive beads 126 is effective, by substantially reducing variations in flow resistance between the wrapper and filter portion surface.

The diameter of the filter portion 120 should be maintained at not less than the minimum expected tobacco section diameter. Since some difference in size is inevitable it is preferable that the filter portion diameter should be less than the tobacco section diameter at least for the reason that in this case the wrapper will be relatively tightly wrapped around the tobacco section and any excess adhesive squeezed out between the wrapper and the tobacco section could be white so that it would not be readily visible. If on the other hand the filter portion diameter were to be greater than the tobacco section diameter then the wrapper would probably be slightly spaced from the tobacco section so that a black line would show and spoil the appearance of the filter cigarette.

The garniture of the assembler may be subject to servo-control to maintain its effective diameter at substantially the same value as that of the maker producing the tobacco sections being assembled. It is desirable to minimize the pressure exerted in the garniture, in view of the different hardnesses of the filter portions and tobacco sections.

The adhesive of the beads 126 may typically be a thick starch adhesive, possibly including fillers, and may be applied by a roller 134 (FIG. 1) using a gravure applicator technique, e.g. as disclosed in British patent specification No. 2134420 and U.S. patent application Ser. No. 573,275, filed Jan. 18, 1984 by Dennis Hinehcliffe, now U.S. Pat. No. 5,562,099, the disclosures of which are hereby incorporated herein in their entirety. The beads 126 may comprise a PVA adhesive with a relatively high viscosity, e.g. 4000 centipoise, and a high solids content, e.g. greater than 50%, with an ability to sit on the surface of the wrapper substrate and fill the gaps between the wrapper and the tobacco section or filter portion. A suitable material for the beads 126 is that manufactured by Swift Adhesives under their reference K9288.

At some loss of sealing effectiveness the inner bead or beads 126 may be replaced by dry collars (e.g. of paper material secured to the wrapper by a thin layer of adhesive) intended to balance the thickness of the outer beads 126: this would provide a saving in use of adhesive.

We claim:

1. Apparatus for conveying rod-like articles of the tobacco industry, particularly in the manufacture of filter cigarettes, comprising means for conveying rod-like articles in axially adjacent positions, means for delivering a wrapper to a plurality of said articles to be united, and wrapping means for feeding said wrapper around at least a portion of each of said plurality of articles to unite said articles, including means for locating a flowable filler material between said wrapper and each of said plurality of articles in the form of at least one relatively thick discrete band positioned about each of said plurality of articles and means for pressing said wrapper onto and around said articles to seal any space between said wrapper and each of said plurality of articles, whereby a composite rod, comprising said plurality of articles, is formed having a wrapper sealingly surrounding at least a portion of each of said articles.

2. Apparatus as claimed in claim 1, wherein said locating means is arranged for applying said flowable filler material to the wrapper at a position upstream of said delivering means.

3. Apparatus as claimed in claim 2, wherein said delivering means includes means for conveying a substantially continuous wrapper, said locating means being arranged to apply said flowable filler material to said continuous wrapper at regularly spaced regions.

4. Apparatus as claimed in claim 3, wherein said delivering means includes means for severing said continuous wrapper at positions between said regions of said flowable filler material, said severing means being located between said applying means and said delivering means.

5. Apparatus as claimed in claim 2 wherein said locating means is adapted to apply said flowable filler material as said at least one band at or near at least one edge of said wrapper.

6. Apparatus as claimed in claim 2 wherein said locating means is adapted to apply said flowable filler material as at least one line of adhesive to said wrapper in an axial direction relative to said rod-like articles for adhesively locating said wrapper relative to said articles.

7. Apparatus as claimed in claim 1, wherein said conveying means is arranged to convey a substantially continuous stream of articles in an axial direction.

8. Apparatus as claimed in claim 7, wherein said wrapping means includes means for resiliently pressing the wrapper onto and around the articles.

9. Apparatus as claimed in claim 8 wherein said means for resiliently pressing said wrapper onto and around said plurality of articles is adapted to apply a greater pressure to said wrapper than to other parts of said articles.

10. Apparatus as claimed in claim 7, wherein said conveying means is arranged to convey substantially parallel streams of articles and said delivery means is arranged to deliver separate wrappers to articles in each of said streams.

11. Apparatus as claimed in claim 10, wherein said conveying means includes means for converting a first stream of articles into second and third substantially parallel streams of articles.

12. Apparatus as claimed in claim 7, wherein said conveying means includes means for conveying first articles and means for conveying second articles, and means for combining said first and second articles in a common stream, each of said means for conveying first articles and said means for conveying second articles including means for conveying substantially parallel streams of articles.

13. Apparatus as claimed in claim 7 wherein said wrapping means is adapted to wrap said wrapper around said plurality of articles as said articles are moved in said axial direction.

14. Apparatus as claimed in claim 1 wherein said locating means is adapted to apply said flowable filler material as said at least one band in the form of a bead of adhesive.

15. Apparatus as claimed in claim 1, further comprising means for cutting said composite rod intermediate the ends of at least one of said articles, said locating means being arranged to apply said flowable filler material to form at least two separate spaced bands around said at least one article and said cutting means being arranged to cut said composite rod between said bands.

16. Apparatus as claimed in claim 15, wherein said locating means is arranged such that said separate spaced bands formed around said at least one article are each closer to the middle of said at least one article than they are to each end of said at least one article.

17. Apparatus as claimed in claim 1, wherein said locating means is arranged to apply said flowable material to form said bands such that, in said composite rod, an annular space is formed between said wrapper and end portions of said plurality of articles between said bands, whereby air flow over the surfaces of said end portions in said space is possible.

18. Apparatus as claimed in claim 17, wherein said locating means is arranged to apply said flowable material to form said bands such that said annular space has a radial width of about 0.1 millimeters.

19. Apparatus for conveying rod-like articles of the tobacco industry, particularly in the manufacture of filter cigarettes, comprising means for conveying a stream of tobacco sections in an axial direction along a first conveyor path, means for conveying tobacco sections in an axial direction along second and third conveyor paths on which paths said sections are intercalated with filter portions, and means for receiving selected tobacco sections from said first conveyor path and for transferring them to said second or said third conveyor path, said second and third conveyor paths being disposed at an angle to said first conveyor path and said selected tobacco sections being conveyed substantially in an axial direction between said first and said second or said third path, said receiving and transferring means comprising further conveyor means with a plurality of first carriers and a plurality of second carriers, respectively, having a common path portion adjacent said first conveyor path and separate path portions adjacent said second and third conveyor paths respectively, and transfer means for transferring tobacco sections from said first conveyor path to said first and second carriers in said common path portion and for transferring tobacco sections from said first carriers in one of said separate path portions to said second conveyor path and from said second carriers in the other of said separate path portions to said third conveyor path.

20. Apparatus as claimed in claim 19, wherein the second and third conveyor paths are parallel and substantially at right angles to the first conveyor path.

21. Apparatus as claimed in claim 19, wherein said first and second carriers are adapted to hold tobacco sections by means of suction, and said transfer means comprises means for controlling the supply of suction to said first and second carriers.

22. Apparatus for conveying rod-like articles of the tobacco industry, particularly in the manufacture of filter cigarettes, comprising first and second endless conveyors having respective carriers for rod-like articles which have a common path portion and which each have path portions which are not common with any path portion of the carriers of the other conveyor, including means for transferring rod-like articles to the carriers of either conveyor in said common path portion, and means for releasing said articles on said path portions which are not common.

23. Apparatus as claimed in claim 22, wherein said path portions on which the articles are released are parallel.

24. Apparatus as claimed in claim 22, wherein said conveyors include curved path portions between said common path portion and said release positions.

25. Apparatus as claimed in claim 22, wherein said conveyors include diverging path portions.

26. Apparatus for conveying rod-like articles of the tobacco industry, particularly in the manufacture of filter cigarettes, comprising an endless conveyor including at least one carrier for rod-like articles, guide means defining a concave path portion for the conveyor, suction means for maintaining the conveyor in contact with the guide means against tension in the conveyor and also for retaining a rod-like article on said carrier, and air pressure means for supplying air under pressure to reduce friction between the guide means and the conveyor.

27. Apparatus for conveying rod-like articles of the tobacco industry, particularly in the manufacture of filter cigarettes, comprising means for conveying rod-like articles in axially adjacent positions, means for delivering a wrapper to a plurality of said articles to be united, and wrapping means for feeding said wrapper around at least a portion of said plurality of articles to unite said articles, including means for locating a flowable filler material between said wrapper and each of said plurality of articles in the form of at least one relatively thick discrete band positioned about each of said plurality of articles and means for pressing said wrapper onto and around said articles to seal any space between said wrapper and at least one of said articles, whereby a composite rod, comprising said plurality of articles, is formed having a wrapper sealingly surrounding at least a portion of each of said articles, said locating means being arranged to apply said flowable material to form said at least one band such that, in said composite rod, an annular space is formed between said wrapper and said at least one of said articles, whereby air flow over the surface of at least one article in said space is possible.

28. Apparatus as claimed in claim 27, wherein said locating means is arranged to form said at least one band of said flowable material such that said annular space has a radial width of about 0.1 millimeters.

* * * * *